United States Patent [19]

Skatsche et al.

[11] 4,428,338

[45] Jan. 31, 1984

[54] INTERNAL COMBUSTION ENGINE

[75] Inventors: Othmar Skatsche; Gerhard Feichtinger; Helmut Melde-Tuczai; Bruno Schukoff, all of Graz, Austria

[73] Assignee: Hans List, Graz, Austria

[21] Appl. No.: 372,549

[22] Filed: Apr. 28, 1982

[30] Foreign Application Priority Data

May 13, 1981 [AT] Austria ..... 2145/81
Jun. 29, 1981 [AT] Austria ..... 2893/81

[51] Int. Cl.[3] ..... F02B 77/00

[52] U.S. Cl. ..... 123/198 E; 123/195 C; 123/195 S; 181/204

[58] Field of Search ..... 123/198 E, 195 C, 195 S; 181/204

[56] References Cited

U.S. PATENT DOCUMENTS 4,071,008 1/1978 Skatsche et al. ..... 123/195 S
4,203,409 5/1980 Fachbach et al. ..... 123/198 E
4,213,439 7/1980 Feichtinger et al. ..... 123/198 E
4,244,438 1/1981 Willmann ..... 123/198 E
4,327,679 5/1982 Crouch et al. ..... 123/195 C

*Primary Examiner*—Ira S. Lazarus
*Attorney, Agent, or Firm*—Watson, Cole, Grindle & Watson

[57] ABSTRACT

An internal combustion engine whose engine unit support, comprising such sound-generating parts as cylinders, cylinder head, piston rods, crankshaft bearings, crankshaft, is provided with a bracket of at least two arms at least at its output end. This bracket is attached to the bearing seats of the crankshaft and is provided with at least one sound-insulating element at each end of its arms for connecting said engine unit support to the crankcase. This will reduce any relative movements between the crankshaft and the crankcase in a simple manner.

10 Claims, 13 Drawing Figures

INTERNAL COMBUSTION ENGINE

BACKGROUND OF THE INVENTION

The present invention relates to an internal combustion engine whose engine unit support, comprising such sound-generating parts as cylinders, cylinder head, pistons, piston rods, crankshaft bearings, crankshaft, is attached to the crankcase by means of several sound-insulating and force-transmitting elements insulating the crankcase against structure-borne sound. These elements are of substantially hollow-cylindrical shape and are located outside of the oil-wetted area in the crankcase, with their axes being parallel to the axis of the crankshaft.

DESCRIPTION OF THE PRIOR ART

German laid-open print No. 26 12 182 contains a description of an internal combustion engine whose engine unit support with its sound-generating parts is separated from the crankcase by a flexible element located between the upper edge of the upwardly extended crankcase and a flange running around the engine unit support. In this known type of design, the flexible element will both insulate against structure-borne sound and serve as a sealing protecting the crankcase from the loss of oil at its upper edge. Although this arrangement will efficiently prevent the transmission of structure-borne sound from the engine unit support to the crankcase, it has two disadvantages: the combined insulating-/sealing element will permit comparatively strong relative movements between crankshaft and crankcase, and the useful life of the flexible element is shortened by its being in contact with hot lubricating oil from the crankcase interior.

Another variant of an internal combustion engine is described in German laid-open No. 29 20 081, in which the sound-insulating elements for holding the engine unit support in the crankcase are fastened both to the crankcase wall so as to be accessible from outside and to the walls of the main bearings of the engine unit support. Although this design will slightly reduce the relative movements between crankshaft and crankcase, the flexible sound-insulating elements are subject to an even greater wear due to their exposure to the hot motor oil.

A similar type of combustion engine is covered by British Pat. No. 1 137 693, which does not have an engine unit support held in the crankcase by means of sound-insulating elements, but whose crankshaft bearings are elastically supported in the crankcase in order to reduce the transmission of structure-borne sound to the crankcase. This known type of design suffers from the disadvantage that the sound-insulating elements will have to be rather rigid on account of their being part of the flow of force between combustion chamber and crankshaft, which will permit a fairly precise alignment of the crankshaft axis and the adjoining driven parts, but will greatly reduce the sound-insulating properties of the assembly. Besides, the sound-insulating elements are badly exposed to the hot-motor-oil in this type of design.

Another combustion engine of the abovementioned type is finally known from German laid-open print No. 28 49 860, in which individual sound-insulating elements are located outside of the crankcase area sealed against oil by a special flexible sealing element, and are therefore not subject to attack by the hot lubricant. The axes of these hollow, cylinder-shaped elements insulating against structure-borne sound run parallel to the axis of the crankshaft. With regard to the requirements of modern "crash tests," this arrangement has proved to be of great advantage for all motor vehicles whose combustion engines are positioned transversely to the long axis of the vehicle—a design characteristic of the majority of modern cars—, since the permissible radial deformation or stress of such flexible elements is much higher than the corresponding values in the axial direction. Due to the rather elevated position of the flexible elements relative to the crankshaft axis, this design variant will permit larger relative movements between crankshaft and crankcase or the adjoining engine components, however, which may require the use of a flexible output coupling or of special elements restricting the movement of the engine unit support in the area of the crankshaft axis.

SUMMARY OF THE INVENTION

It is an object of the present invention to improve combustion engines of the abovementioned type by modifying the way of mounting the engine unit support in the crankcase while maintaining the favorable location of the sound-insulating and force-transmitting elements between engine unit support and crankcase outside of the oil-wetted area of the crankcase, and thereby reducing the possible movements between crankshaft and crankcase in a simple manner at the same time.

According to the present invention this is achieved by providing a bracket of at least two arms at least at the output end of the engine unit support, which bracket is attached to the bearing seat of the crankshaft and is provided with at least one sound-insulating element at each end, and by positioning the sound-insulating elements symmetrically with respect to the crankshaft axis. This particular arrangement of insulating elements relative to the crankshaft axis will reduce the relative movements of the engine unit support which are made possible by the flexibility of the insulating elements, and will limit them to a swinging movement around the crankshaft axis itself, thus eliminating the need of separate compensating elements or stops at the output end of the engine unit support.

In an enhanced version of this invention a two-armed bracket is to be mounted on either end of the engine unit support, with the symmetry axes of the brackets through the sound-insulating elements and the crankshaft axis being inclined towards each other at an angle of approximately 90 degrees, as seen in the direction of the crankshaft axis. This X-type arrangement of the brackets will reduce the swinging movements of the engine unit support relative to the crankcase in a simple and most satisfactory way, while permitting the sound-insulating suspension to remain fully effective. The two-armed bracket can be manufactured easily and may be placed at an oblique angle relative to the center plane of the engine—as seen in the direction of the crankshaft axis—, which eliminates the need for widening the crankcase.

The invention may be further improved by providing the bracket with center holes which—together with center pins to be inserted into respective holes in the crankcase—will indicate the accurate position of the crankshaft axis during the assembly of the engine unit support. This will permit a much simpler way not only of mounting the engine unit support but also of replacing the sound-insulating elements, since the relative position between engine unit support and crankcase, and thus between crankshaft axis and adjacent output elements, may be perfectly adjusted even before inserting the sound-insulating elements.

According to another proposal of the invention, setting elements may be used to great advantage in this context in order to adjust the position of the sound-insulating elements borne by the brackets relative to the crankcase in such a way as to make the preloading of the sound-insulating elements completely independent of this adjustment. Experience has frequently shown that in combustion engines whose engine unit supports are suspended in the crankcase by means of sound-insulating elements, the possible degree of sound insulation will largely depend on manufaturing and mounting tolerances, since—due to the sound-insulating elements being attached to the engine unit support, or rather to the crankcase—these tolerances will directly lead to differences in the preloading of the individual flexible elements of all variants known, which will result in different vibration and damping characteristics. This disadvantage is eliminated by making the sound-insulating elements adjustable before they are fully fastened in place.

According to a further enhancement of the invention, the setting elements are configured as washers of a graded thickness, which may be inserted between the crankcase and a mounting flange at the sound-insulating element in question. This simple device will permit easy adjustment of the sound-insulating elements.

In another variant of the invention, the bracket is a pressed part made of sheet metal and reinforced by beading, which will simplify manufacture and will have little bearing on either weight or the exterior dimensions of the internal combustion engine.

In order to avoid moments of torsion in the bracket, another improvement of the present invention envisages that each end of the bracket be provided with two suitably aligned insulating elements between which the bracket is braced firmly.

The internal combustion engine illustrated in FIGS. 1 through 6, which might be found in an automobile, is attached and mounted in an entirely conventional manner by means of additional flexible elements and consoles which are screw-fastened to the vehicle frame and to the crankcase or the gearbox case. This particular flow of force may lead to comparatively high stresses and deformations in the crankcase, which may impair the efficiency of sound reduction due to the reduced sound-absorption by the crankcase. In order to facilitate mounting of the entire combustion engine without affecting the insulation of structure-borne sound, a further improvement is concerned with providing brackets for both ends of the engine unit support, one of which will bear at least one additional sound-insulating element and the other at least two additional sound-insulating elements positioned at opposite ends, which are not connected to the crankcase but located outside of it, and which are used for the purpose of supporting the internal combustion engine, e.g., in a motor car it powers. In this way the crankcase no longer has to transmit the forces originating at the engine unit support to the mounting elements of the internal combustion engine, which will prevent any stresses and deformations impairing the sound-damping qualities of the crankcase from occurring in the vicinity of the mounting elements.

Another enhanced version of the present invention proposes that the additional sound-insulating elements each be placed at one end of the bracket together with the sound-insulating elements holding the engine unit support in the crankcase. Thus the bracket will not require any modifications as compared to the variant of the engine unit support being directly borne by the crankcase; only the fastenings of the sound-insulating elements at the ends of the bracket arms will have to be modified in order to enable the additional sound-insulating elements supporting the internal combustion engine to be attached as well.

Finally, a further elaboration of the invention provides a separate bracket arm for each of the addition sound-insulating elements, with its end projecting from an opening in the crankcase, carrying a cover for preventing the radiation of sound in this area. In this way the mounting elements of the combustion engine itself are independent of the elements attaching the engine unit support to the crankcase, which will permit an individual selection of the ideal places for fastening the sound-insulating elements. Since the brackets are located outside of the oil-wetted area of the crankcase, the openings through the crankcase for the additional bracket arms will have to be made sound-proof but not oil-tight.

DESCRIPTION OF THE DRAWING

Following is a more detailed description of exemplary embodiments of the invention, as illustrated by the enclosed drawing, wherein.

DESCRIPTION OF THE PREFERRED EMBODIMENTS

Figure 1:
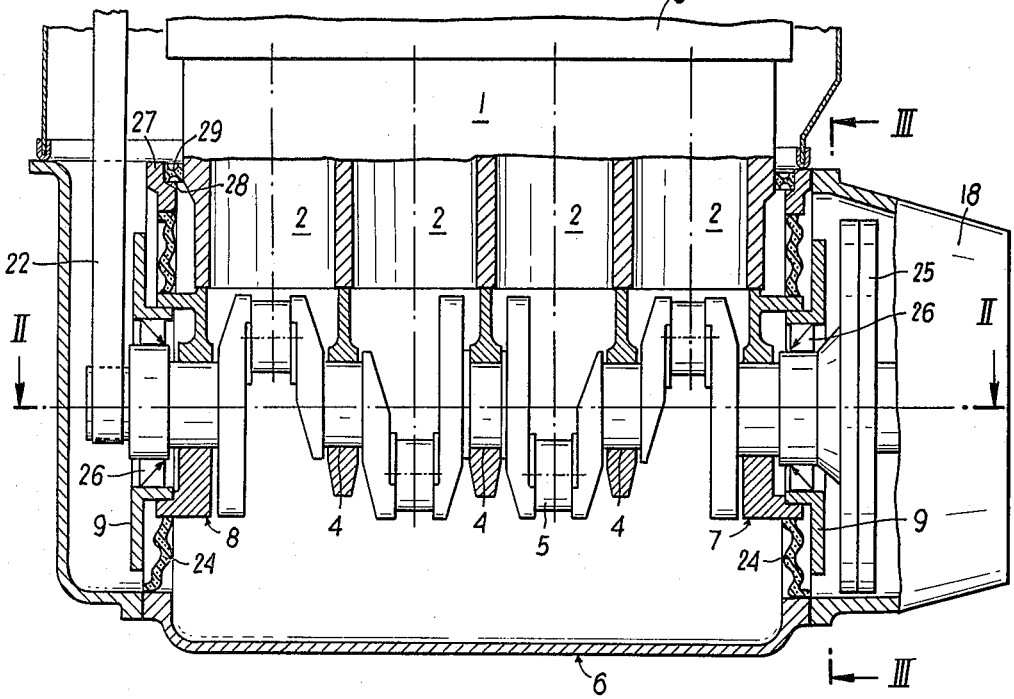
FIG. 1 is a schematical view of a longitudinal section through an internal combustion engine as described.
Figure 2:
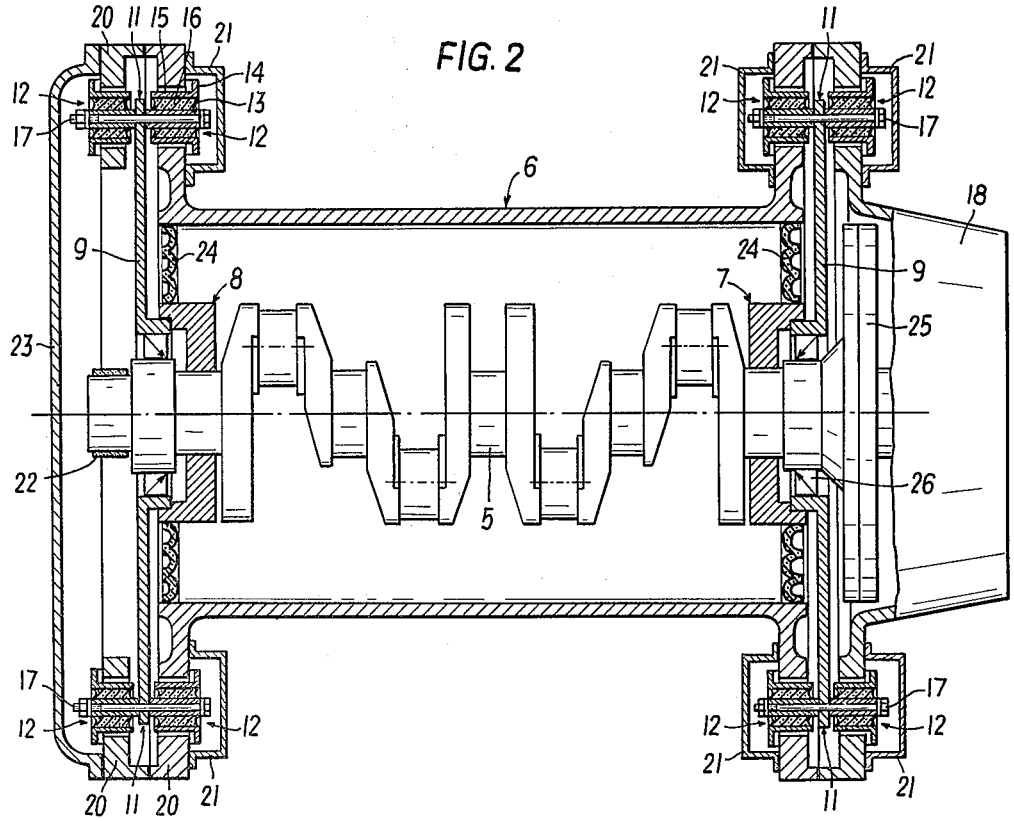
FIG. 2 is a section along line II—II in FIG. 1.
Figure 3:
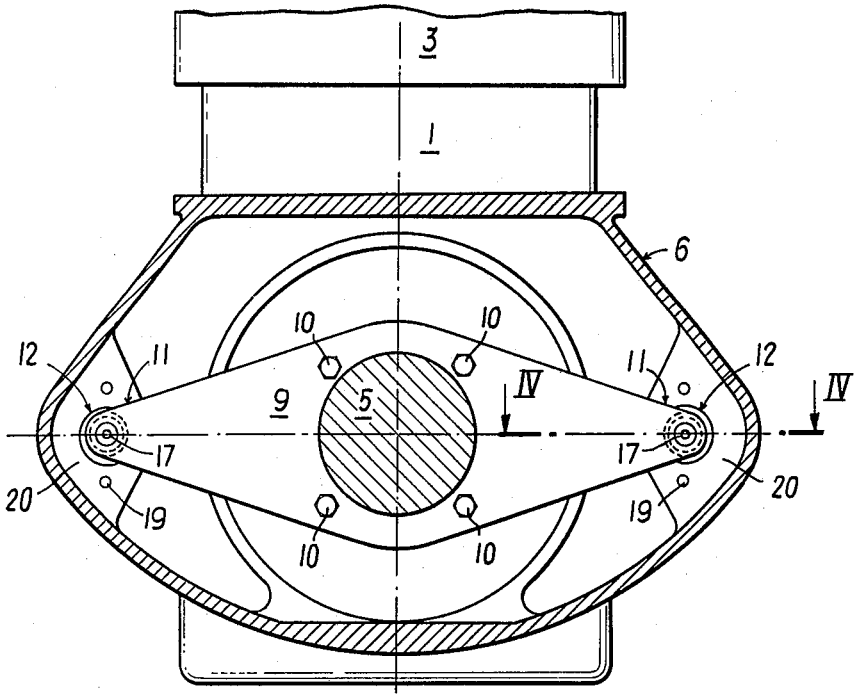
FIG. 3 is a section along line III—III in FIG. 1.

The internal combustion engine illustrated in FIGS. 1 to 3 is provided with an engine unit support 1 comprising such sound-generating components as cylinders 2, cylinder head 3, pistons and piston rods (not shown here), crankshaft bearings 4 and crankshaft 5, which is attached to the crankcase 6 by means of sound-insulating elemts; as a consequence, the crankcase 6 itself is sound-insulated as well. For this purpose, the engine unit support 1 is supplied both at the output end 7 and at the opposite end 8 with a two-armed bracket 9 which is fastened with screws 10 to the outermost bearing seats of the crankshaft bearings 4 or to the engine unit support 1 in the vicinity of the outermost crankshaft bearing seats, and which bears two sound-insulating elements 12 at each of its ends 11. In the variant illustrated, the sound-insulating elements 12 consist of an inner cylinder or jacket 13, of an outer cylinder or jacket 15 provided with a mounting flange 14 and of an elastic material 16 filling the space between the two cylindrical jackets, which prevents the propagation of structure-borne sound between the inner jacket 13 and the outer jacket 15 and any further parts connected to them.

The sound-insulating elements 12 are fastened to the brackets 9 with through-bolts 17 which will press the inner jackets 13 of two elements opposing each other against the brackets 9. The outer jackets 15 are attached to the crankcase 6 or rather to the flywheel housing 18 connecting to the crankcase by means of mounting flanges 14, which are fastened to special lugs 20 on the crankcase or flywheel housing with through-bolts 19. In order to prevent the radiation of sound via the inner jackets 13 and through-bolts 17 connected to the sound-carrying engine unit support, the sound-insulating elements 12 are provided with covers 21; on the side of the engine unit support bearing the drive 22 for the overhead camshaft (not shown here), both the sound-insulating elements 12 and the camshaft drive 22 are covered by a cover 23.

At ends 7 and 8 the engine unit support 1 is provided with flexible oil seals 24 sealing the interior of the crankcase 6 against the loss of oil; as they do not bear any structural load they are of a material soft enough to inhibit the transmission of any structure-borne sound from the engine unit support 1 to the crankcase 6. The crankshaft itself is sealed against oil-loss by rotary shaft seals 26 both at the side of the flywheel 25 and at that of the camshaft drive 22. FIG. 1 also shows the seal at the upper edge 27 of the crankcase 6 against the engine unit support 1. For this purpose a flexible sealing element 29 (schematically indicated in this drawing) is inserted into a groove 28 running along the entire crankcase,—again without any load-bearing function.

The sound-insulating elements 12 are thus positioned outside of the crankcase interior and are therefore not exposed to the spray of hot lubricant, which greatly extends the life of these elements.

As is revealed by FIGS. 2 and 3, the sound-insulating elements 12 which are shaped as hollow cylinders, are positioned such that their axes run parallel to the axis of the crankshaft 5. In view of a marked preference of the modern car designer for a transverse position of the engine relative to the vehicle's longitudinal axis, this positioning is of advantage as it permits the sound-insulating elements to absorb the high accelerations required during the so-called "crash-tests" with small radial deformations only.

Furthermore, it is of particular advantage that the arrangement of the sound-insulating elements 12 is symmetrical with respect to the axis of the crankshaft 5, since with this arrangement the relative movements between the engine unit support 1 and the crankcase 6, which are made possible by the flexibility of the sound-insulating elements 12, will be reduced to a swinging movement around the axis of the crankshaft 5, thereby eliminating the necessity of stops or flexible linkages at the output end of the crankshaft, which would otherwise be required for restricting the movements of the crankshaft relative to other output elements not shown in this drawing.

Another advantage of the internal combustion engine represented here is that the crankcase may be of the one-piece die-cast type due to the particular mounting system used for the engine unit support.

As a variant to the embodiment shown, a multi-armed bracket would be conceivable, with at least one sound-insulating element at each of its ends for attaching the engine unit support to the crankcase.

Figure 4:
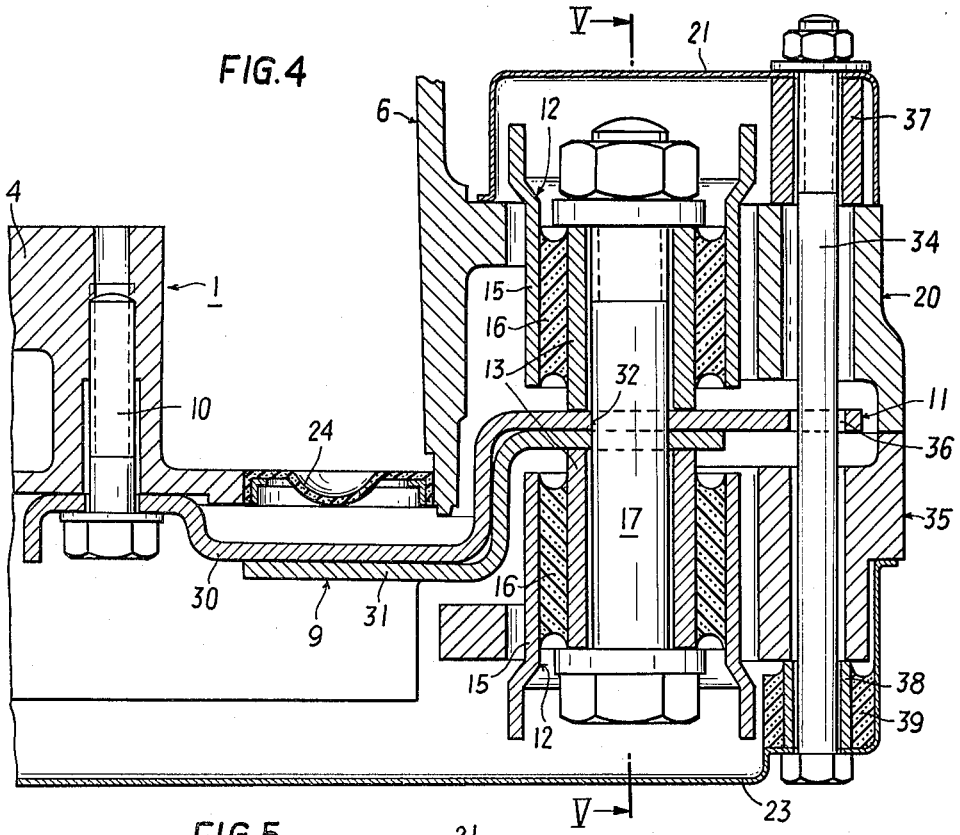
FIG. 4 is an enlarged detail from another embodiment of the invention, of a section corresponding to that along line IV—IV in FIG. 3.
Figure 5:
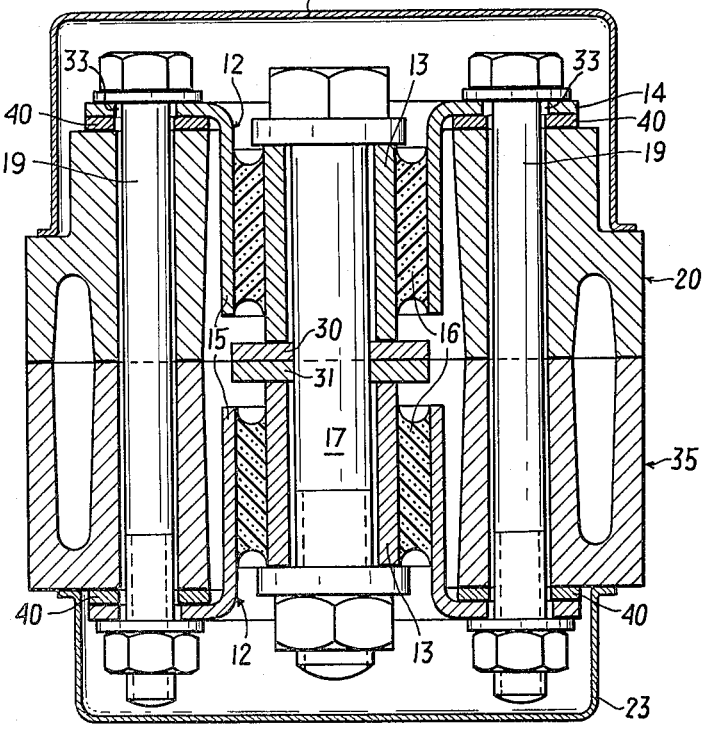
FIG. 5 shows a section along line V—V in FIG. 4.

FIGS. 4 and 5 are concerned in detail with the arrangement of the sound-insulating elements of an internal combustion engine as specified. Bracket 9 is fastened with screws 10 to the engine unit support 1, or rather to the crankshaft bearing seats opposite of the flywheel (not shown here); in this variant it consists of a pressed part 30 made of sheet metal and of a special reinforcing part 31 in the area subject to the greatest load between the screws 10 and the through-bolt 17. It has an opening 32 for the through-bolt 17 at its end 11, which is used for attaching the inner jackets 13 of the sound-insulating elements 12 to either side of the bracket 9. The outer jacket 15 which is sound-insulated from the inner jacket 13 by means of the flexible material 16, is provided with a mounting flange 14 with through-holes 33 for further through-bolts 19 positioned symmetrically to the through-bolt 17, which are used for fastening the sound-insulating elements 12 to a lug 20 of the crankcase 6 or to a separate part 35 fastened with screws 34 to the lug 20 of the crankcase 6. The screw 34 has sufficient play relative to a bore 36 at end 11 of the bracket 9 in order to ensure that the relative movements between the engine unit support 1 and the crankcase 6, which are made possible by the flexible elements 12, will not be impeded during operation of the internal combustion engine. In addition to fastening the separate part 35 to the lug 20 of the crankcase 6, the screws 34 are used for fastening the cap 21 and the cover 23 with the help of distance sleeves 37, 38, the cover 23 being made vibration-proof by means of an additional flexible element 39 in this variant.

As discussed under FIGS. 1 to 3, a flexible oil seal 24 is placed between the engine unit support 1 and the crankcase 6, which—together with the sealing elements at the upper edge of the engine unit support and at the outermost crankshaft bearings (not shown here)—will ensure that the sound-insulating elements 12 are located outside of the oil-wetted interior of the crankcase 6.

As can be seen in FIG. 5, setting elements 40 in the shape of washers are positioned between the crankcase, or rather the lug 20 and the separate part 35, and the mounting flange 14 of the sound-insulating elements 12, which will permit adjusting the position of the adjoining elements relative to each other in the direction of the axis of the sound-insulating elements 12 in such a way as to make the preloading of the assembled sound-insulating elements 12 independent of any tolerances resulting during manufacture or assembly of the internal combustion engine. Since the washers 40 are replaceable it will be possible to select a washer of adequate thickness during the assembly of the internal combustion engine or upon replacement of a sound-insulating element. In combunation with the through-holes 33 which are slightly larger in diameter than would be necessary for the screws 34, this is a simple device for eliminating any uncontrollable and undesirable preloadings of the individual sound-insulating elements which would lead to different sound-damping characteristics.

Figure 6:
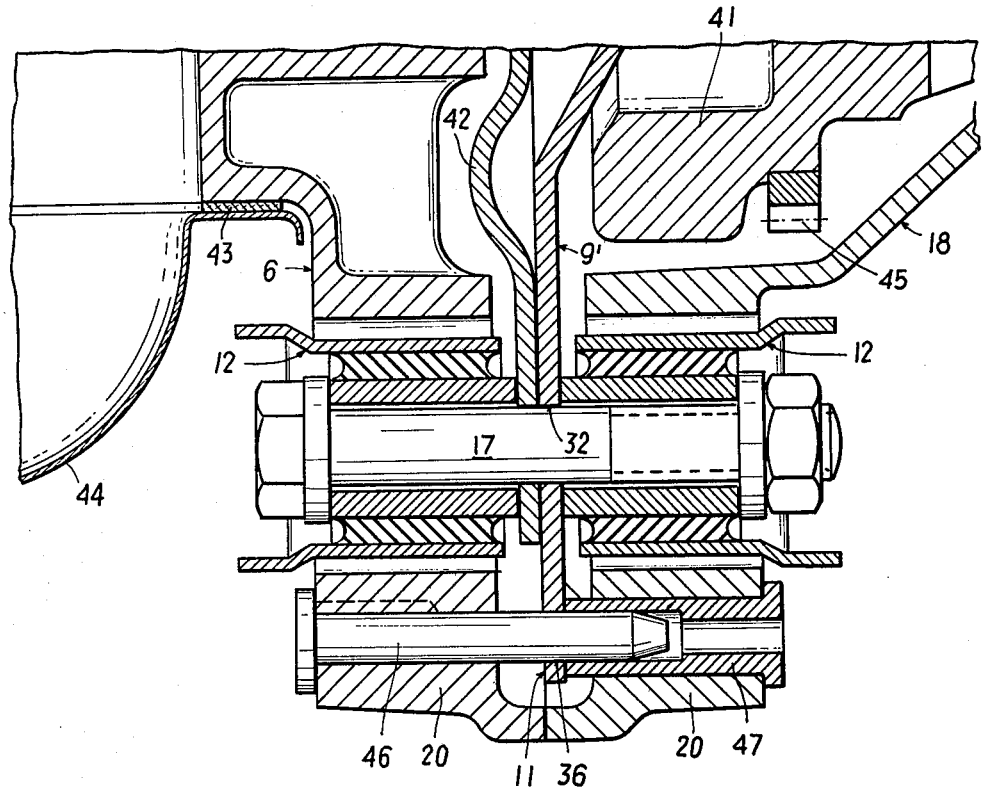
FIG. 6 shows a section through another embodiment of the invention during assembly, basically corresponding to that in FIG. 4.

The arrangement according to FIG. 6 differs from that of FIG. 4 in so far as in FIG. 6 the sound-insulating elements 12 are shown on the output side of the engine unit support or rather on the side of the flywheel 41.

The elements 12 again are attached to the bracket 9'—a pressed sheet metal part reinforced with beadings 42—and to the crankcase 6 and to the flywheel housing 18 or to the respective lugs 20. An oil-sump 44 is attached to the crankcase 6 cushioned by a seal 43; furthermore, the flywheel 41 contains a toothed wheel rim 45 meshing with a starter pinion (not shown).

FIG. 6 shows the arrangement of the sound-insulating elements 12 with the covers removed during the assembly of the internal combustion engine or while one of the sound-insulating elements is being replaced. Instead of the screw 34 a center pin 46 has been inserted, fitting loosely into the bore 36 at the end 11 of the bracket 9, which serves for the accurate adjustment of the relative position of the engine unit support and the crankcase during the assembly of the internal combustion engine. In order to prevent the bracket 9' from being bent or damaged during the insertion of the center pin 46, a sleeve 47 is inserted from the side of lug 20 of the flywheel housing 18, with a bore for holding the center pin.

During the assembly of the combustion engine or the replacement of the sound-insulating elements the center pin 46 may be used for aligning the engine unit support relative to the crankcase before the sound-insulating elements are being fastened and the tolerances are being compensated in the manner described in detail under FIG. 5.

Figure 7:
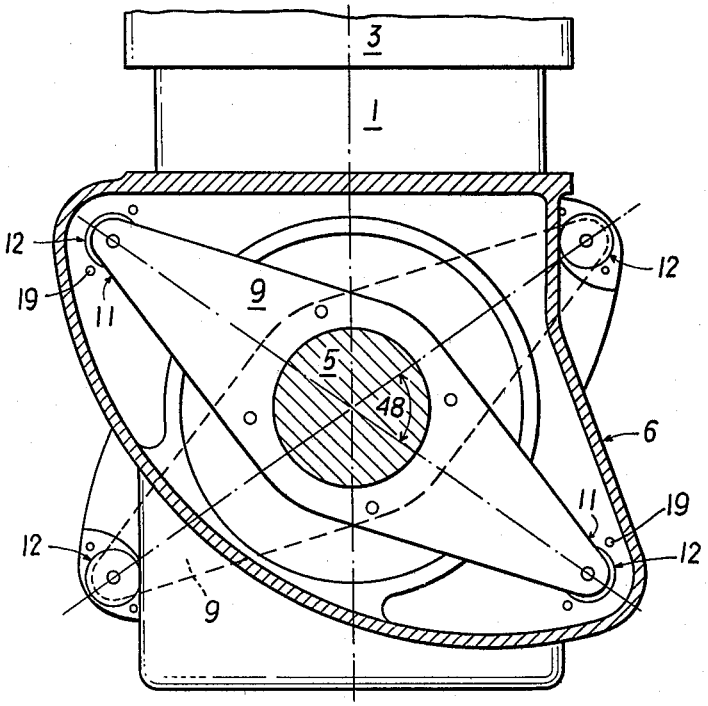
FIG. 7 shows a section through another embodiment of the invention corresponding to that in FIG. 3.

The internal combustion engine schematically indicated in FIG. 7 differs from that in FIG. 3 by the use of two brackets 9 at the opposite ends of the engine unit support, which are positioned such that they include an angle 48 as seen in the direction of the axis of the crankshaft 5. Due to this arrangement the movements of the engine unit support 1 relative to the crankcase 6, which are made possible by the flexible sound-insulating elements 12, are reduced to a minimum in a simple manner without impairing the sound-insulating properties.

Figure 8:
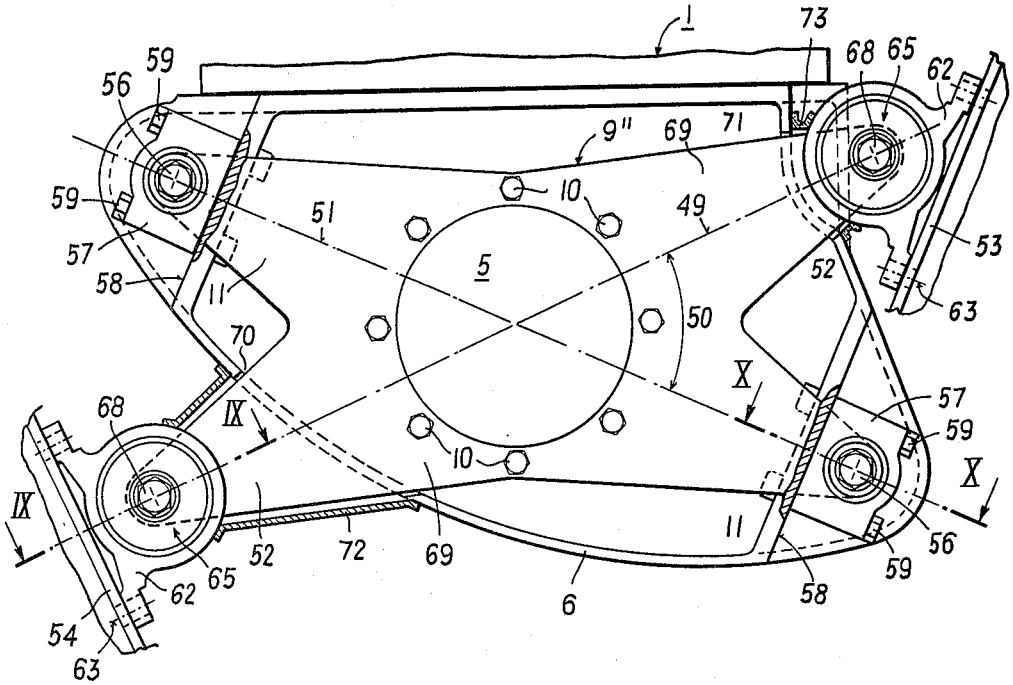
FIG. 8 is a cross-sectional view (partially schematised) of another embodiment of the invention.
Figure 9:
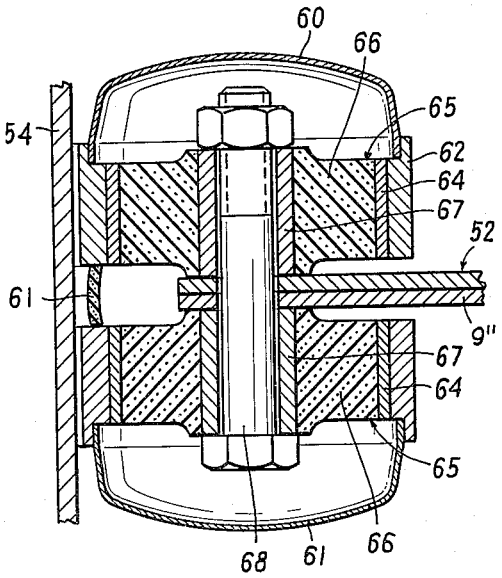
FIG. 9 shows a section along line IX—IX in FIG. 8.
Figure 10:
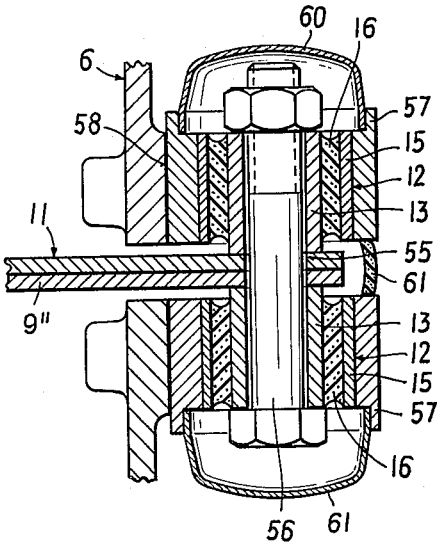
FIG. 10 shows a section along line X—X in FIG. 8.

The internal combustion engine illustrated in FIGS. 8 to 10 is provided with an engine unit support 1 which comprises the sound-generating parts of the engine (not shown in detail) and is held in the crankcase by sound-insulating elements, thus rendering the crankcase 6 itself sound-proof. For this purpose a four-armed bracket 9" is mounted on either side of the engine unit support 1, which is fastened with screws 10 to the outermost seats of the crankchaft bearings (not shown here). While two of the ends 11 of this bracket 9", which are opposed to each other with respect to the axis of the crankshaft 5, will serve as a sound-insulating suspension of the engine unit support 1 in the crankcase 6, its other two ends 52, which again are opposed to each other with respect to the axis of the crankshaft 5 and whose symmetry axis 49 includes an angle 50 with the symmetry axis 51 of the ends 11, are used for directly mounting the engine unit support and thus the entire combustion engine on a vehicle frame indicated by parts 53 and 54 in this drawing.

The flexible suspension of the engine unit support 1 in the crankcase 6 via the ends 11 of the bracket 9" can be seen more clearly in FIG. 10. The end 11 of the bracket 9" which is a two-part pressed component made of sheet metal in this variant, has an opening 55 holding a screw 56 which will fasten two sound-insulating elements 12 by pressing the inner jackets 13 against the bracket 9". The outer jackets 15 of the sound-insulating elements 12 are insulated against vibrations from the inner jackets by means of a flexible material 16, and are inserted into mounting elements 57, which are attached to suitable mounting surfaces 58 on the crankcase 6 with screws 59. In order to prevent the radiation of sound from the screws 56 or from ends 11 of the bracket 9", the mounting elements 57 are provided with covers 60 and 61.

FIG. 9 illustrates in which way the ends 52 of the bracket 9" are attached to the frame element 54 of a vehicle (not shown here). This variant also includes a separate mounting element 62 which is fastened to the frame element 54 with screws indicated by their axes 63 in FIG. 8, and will hold the outer jackets 64 of two sound-insulating elements 65. The inner jackets 67 which are sound-insulated from the outer jackets 64 by means of a flexible material 66, are attached to the end 52 of the bracket 9" with a through-bolt 68. Those parts into which structure-borne sound from the engine unit support 1 is directly fed via the bracket 9", are again provided with covers 60, 61 in order to prevent the sound from radiating into the environment.

The openings 70 and 71 of the crankcase from which the additional bracket arms 69 project, are sound-proofed by means of flexible sound-absorbing covers 72, 73—the crankcase 6 already being oil-sealed in the vicinity of the brackets 9" in a manner not shown here.

The above system of mounting an internal combustion engine, e.g., in a motor vehicle it powers, will ensure in a most advantageous way that the reaction forces of the engine unit support are directly transmitted to the elements supporting the combustion engine, thereby preventing stresses and deformations in the crankcase which would be caused if the reaction forces were picked up by the crankcase and would drastically reduce the sound-insulating properties of the crankcase.

Figure 11:
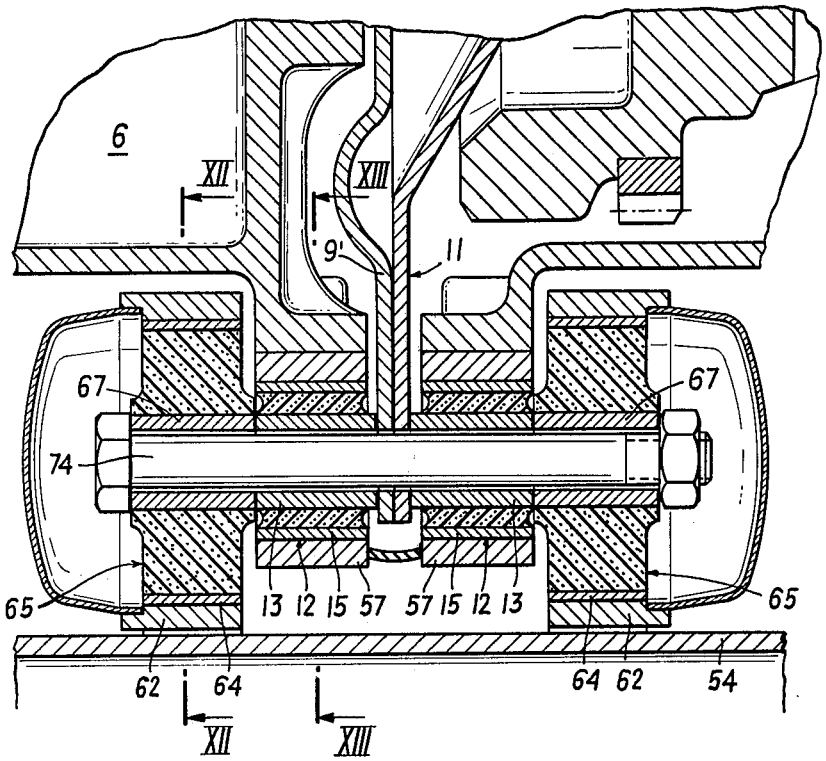
FIG. 11 shows a partial section through another embodiment of the invention.
Figure 12:
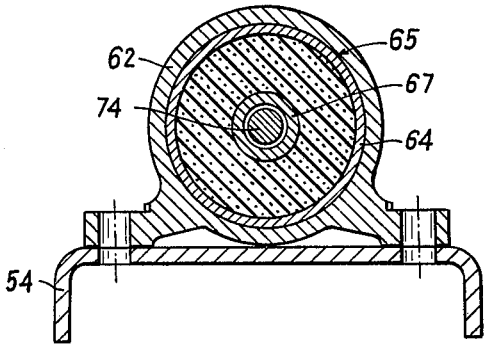
FIG. 12 shows a partial section along line XII—XII in FIG. 11.
Figure 13:
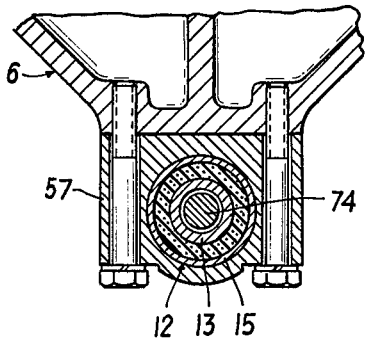
FIG. 13 shows a partial section along line XIII—XIII in FIG. 11.

In the variant illustrated in FIGS. 11 to 13, the additional sound-insulating elements 65 which are used for mounting the combustion engine on a frame element 54 of a vehicle not shown, each are attached to an end 11 of the bracket 9' together with the sound-insulating elements 12 fastening the engine unit support (not shown in this drawing) to the crankcase 6. The inner jackets 13, 67 of the elements 12, 65 are fastened to the end 11 of the bracket 9' with one common through-bolt 74; as to the arrangement of the outer jackets 15, 64 and the mounting elements 57, 62 at the crankcase 6 or at frame element 54, cf. description of FIGS. 8 to 10.

As before, the reaction forces of the engine unit support will not be picked up by the crankcase since they are directly transmitted to the frame elements 54 via the brackets 9' and the additional sound-insulating elements 65. Thus the sound-insulating function of the crankcase itself is not impaired.

As a variant of the arrangement shown in FIG. 8 one side of the engine unit support could be provided with a bracket including one additional sound-insulating element only for supporting the combustion engine, which would result in a three-point mounting system.

We claim:

1. An internal combustion engine having a crankcase and an engine unit support, said engine unit support comprising such sound-generating parts as cylinders, cylinder head, pistons, piston rods, crankshaft bearings, crankshaft, and being attached to said crankcase by means of several sound-insulating and force-transmitting elements insulating said crankcase against structure-borne sound, said elements being of substantially hollow-cylindrical shape and located outside of the oil-wetted area in said crankcase with their axes being parallel to the axis of said crankshaft, wherein a bracket with at least two arms is mounted at least at the output end of said engine unit support, said bracket being attached to the bearing seat of said crankshaft, and provided with at least one of said sound-insulating elements at each end of said arms, and wherein said sound-insulating elements are positioned symmetrically to said crankshaft axis.

2. An internal combustion engine as in claim 1, wherein a two-armed bracket is mounted on either end of said engine unit support, with the symmetry axes of said two brackets through said sound-insulating elements and said crankshaft axis being inclined towards each other at an angle of approximately 90 degrees, as seen in the direction of said crankshaft axis.

3. An internal combustion engine as in claim 2, wherein said bracket is provided with center holes which—together with center pins to be inserted into respective holes in said crankcase—will indicate the accurate position of said crankshaft axis during the assembly of said engine unit support.

4. An internal combustion engine as in claim 3, wherein setting elements are provided, by means of which the position of said sound-insulating elements borne by said brackets relative to said crankcase can be adjusted in such a way as to make the preloading of said insulating elements independent of this adjustment.

5. An internal combustion engine as in claim 4, wherein said setting elements are configured as washers of various thickness grades which may be inserted between said crankcase and a mounting flange at said sound-insulating element.

6. An internal combustion engine as in claim 1, wherein said bracket is a pressed part made of sheet metal and reinforced by beading.

7. An internal combustion engine as in any of claims 1 to 6, wherein each end of said bracket is provided with two suitably aligned sound-insulating elements between which said bracket is braced firmly.

8. An internal combustion engine as in claim 1, wherein each of the two ends of said engine unit support is provided with a bracket, one bracket bearing at least one additional sound-insulating element and the other at least two additional sound-insulating elements at opposite ends, which elements are located outside of said crankcase and are used for the purpose of supporting the internal combustion engine, e.g., in a motor vehicle it powers.

9. An internal combustion engine as in claim 8, wherein said additional sound-insulating elements each are placed together with the sound-insulating elements holding said engine unit support in said crankcase at one end of said bracket.

10. An internal combustion engine as in claim 8, comprising a separate bracket arm for each of said additional sound-insulating elements, with its end projecting from an opening in said crankcase, and a cover for preventing the radiation of sound in this area.

* * * * *